United States Patent [19]

Jewett

[11] 3,942,198

[45] Mar. 9, 1976

[54] SAFETY BAFFLING AND RELATED EQUIPMENT FOR SWIMMING POOLS

[76] Inventor: Harold A. Jewett, 5451-42nd St., N.W., Washington, D.C. 20015

[22] Filed: Dec. 16, 1974

[21] Appl. No.: 533,256

[52] U.S. Cl. ..... 4/172; 4/172.19; 4/172.21; 272/1 B; 272/56.5 R

[51] Int. Cl.[2] ..... E04H 3/16; E04H 3/18

[58] Field of Search ..... 4/172, 172.19, 172.21; 272/66, 65, 1 B, 1, 56.5 R

[56] References Cited

UNITED STATES PATENTS

| | | | |
|---|---|---|---|
| 1,648,196 | 11/1927 | Rohmer | 272/1 B |
| 2,645,483 | 7/1953 | Smith | 272/66 |
| 2,918,281 | 12/1959 | Towle | 272/66 |
| 2,998,250 | 8/1961 | Wittrup | 272/66 |
| 3,083,965 | 4/1963 | Jewett | 272/66 |
| 3,176,982 | 4/1965 | O'Daniell | 272/65 X |
| 3,269,726 | 8/1966 | Lavell | 272/56.5 R |
| 3,804,405 | 4/1974 | Giddings | 272/66 |
| 3,809,392 | 5/1974 | Kral, Jr. | 272/66 X |
| 3,856,296 | 12/1974 | Fischer | 272/66 |

*Primary Examiner*—Henry K. Artis

[57] ABSTRACT

The invention provides novel safety baffling or baffles for placement in swimming pools at loci underlying the forwardly protruding fronts of poolside slides, diving boards, and diving platforms, and extending any desired distance rearwardly of said fronts as well as forwardly thereof at least a typical diver-body length of 3 to 5 feet but advantageously more. Advantageously each baffle comprises a relatively dense and slippery skid-surfaced lamina carrying "streamlined" slippery-surfaced, cushioning "shingles" plus a less dense subjacent cushioning medium or lamina, e.g., of polyurethane foam or the equivalent, so placed as to obliquely, i.e. glancingly, intercept the trajectory of a headfirst slider or diver sufficiently to at once control or change its direction and reduce his momentum — this process being successively repeated via new such interceptions engendered by change in angularity of said skid surface or of obliquity of downwardly dangling arms of a slide diver along it when it is comprised in a buoyantly floating said baffle; in which latter case characteristic danger of a neck-breaking somersault will be precluded.

10 Claims, 22 Drawing Figures

SAFETY BAFFLING AND RELATED EQUIPMENT FOR SWIMMING POOLS

This application relates to safety baffling for placement subjacently to the fronts or front lips of the diver exit portions of above-water slides and diving boards (both diving boards and slides being included in the expression "projectors" as used herein, provided the fronts of their diver exit portions are disposed at a higher elevation than that of the deck on which they are mounted) which front lips overlie and extend forwardly beyond the edges of the swimming pools, said baffles themselves extending both forwardly and laterally enough to prevent or moderate head, neck or back injuries to headfirst users of such slides or boards, via diverting their trajectories in a skidwise manner, thus substituting lengthened, water-cushioned, momentum-dissipating underwater travel for what otherwise might have been a violently abrupt and direct collision with the bottom wall or a side wall of the pool.

As far as applicant's research has revealed, the prior art contains no disclosure of the idea of so positioning a baffle that it will purposely be glancingly contacted by a diver or head-first slider during use. The reference closest to being of direct prior-art interest on this score appears to be Stillman U.S. Pat. No. 3,429,085. It shows a thick lamina of low-density polyurethane foam covering the side and bottom walls of a pool, which lamina is iself covered by an outer, more dense lamina of the same material; said latter lamina in turn having a "vinyl liner" surfacing so that, as stated in the patent, "a not insubstantial degree of resiliency" is provided which "provides a substantial safety feature". Insofar as applicant recalls, this is the only disclosure in the prior art of a slippery-surfaced cushioning structure which would be presently relevant if it had been present in a pool having a bottom wall configuration useful, per se, for the practice of the invention (Stillman's bottom wall lacks such a configuration), or also showed a slide or diving board at a pertinent location along the edge of the pool (Stillman shows none).

An illustrative disclosure of a pool which, like Stillmn, lacks a disclosure of the subject idea or concept, or even of a slide or diving board, but which might be regarded as having a bottom wall contour of geometric interest, per se, occurs in Brownell U.S. Pat. No. Re. 25,199 (of U.S. Pat. No. 2,887,759). But no cushioning lamina is depicted therein. And the same may be said with regard to a number of further patents that show slides sloping from above water level approximately to bottom walls of various types of pools so that their diver exit lips are submerged in pool water during use. Also, in all such cases of which applicant is aware, the slides are not only cushionless but too narrow, and their up-turned side walls are too dangerous, for the slides to per se serve as baffles for head-first divers or sliders happening to dive downwardly from the platforms at the tops of the slides. In addition, the pools in said cases are too shallow for accommodating baffles fulfilling the requirements set out in the appended claims.

The main object of the invention, then, is the provision of a suitably extensive, smooth, cushioned, inherently slippery skid surface an appropriate distance below and forwardly from the above-water (i.e., higher that the deck) front of an above-water poolside slide or diving board, in position to obliquely intercept a head-first slider or diver at a sufficiently small angle of incidence (characteristically followed by a succession of such angles) as to prevent major injury to him by steering him, so to speak, along a changed momentum-absorbing course, instead of permitting his initial descent to be abruptly and totally terminated by a calamitous collision with pool wall structure, entailing great danger of fatal or near-fatal consequences. In other words, the headfirst slider or diver is automatically spared such consequences by substituting for such a collision a cushioned skidding calculated to produce no more than momentary discomfort, if any.

A special corollary of said main object is to similarly preclude or correct downward dangling of the arms of a headfirst slider during the air-flight portion of his trajectory, to thereby save him from sudden somersaulting and resulting cervical fracture or the like, due to the braking effect of the water against his immersed arms, i.e., unaccompanied by any restraint on the continuing momentum of the rest of his body.

It is a still further object of the invention to arrange a slide, a covnentional diving board, and a novel, extra-powerful diving board of the invention (to be described below) having special utility for the achievement of unprecedentedly high dives, along the sides of a pool deck, so as to respectively provide them with the novel baffles at loci such as to require only a minimum of pool area yet automatically assure maximum avoidance of inter-conflict among users of said slide and respective boards.

The foregoing and still further objects of the invention will become apparent as the description proceeds.

Briefly stated, said foregoing objects are accomplished by placement of said baffles in loci such as designated hereinafter, and employing a suitably contoured, dimensioned and proportioned surface lamina that slopes downwardly-forwardly, presents a smooth (substantially obstruction-free), even and slippery skid-producing upper exterior which is cushioned by a subjacent lamina of advantageously less dense, resiliently yieldable foam or the equivalent; said surface lamina serving to distribute the impact of a diver's head or other upper body part over a relatively large area of the skid surface, thereby preventing substantial friction-producing topical indentation of said surface, while yet supplying sufficient topical cushioning to preclude injurious or pain-producing impact (it being realized that mere prevention of pain or discomfort is relatively insignificant as an object, when compared with that of preventing fatal or worse-than fatal cerebral, cervical or spinal injuries).

In the drawings, wherein all figures are to be understood as basically diagrammatic or schematic, and all expressions such as horizontal, upward, front, rear, etc., as being relative and approximate unless otherwise evident, to be more particularly described later on:

FIG. 1 is a plan view in which the scale of the drawing, as filed, was one-sixteenth inch per foot of pool dimension, thus representing a pool 44 feet in length and 24 feet in width; said pool being equipped with a pair of diving boards (the shorter one being novel per se) and a slide having an above-water forwardly-protruding front; said slide and said diving boards being each provided with safety baffling of the invention disposed in diving zones located adjacently frontward of them;

Figure 1:
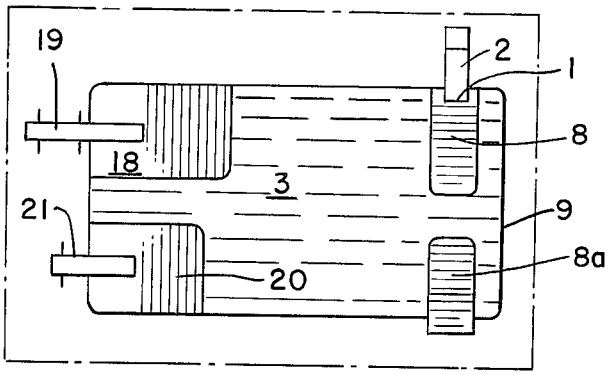
Figure 2:
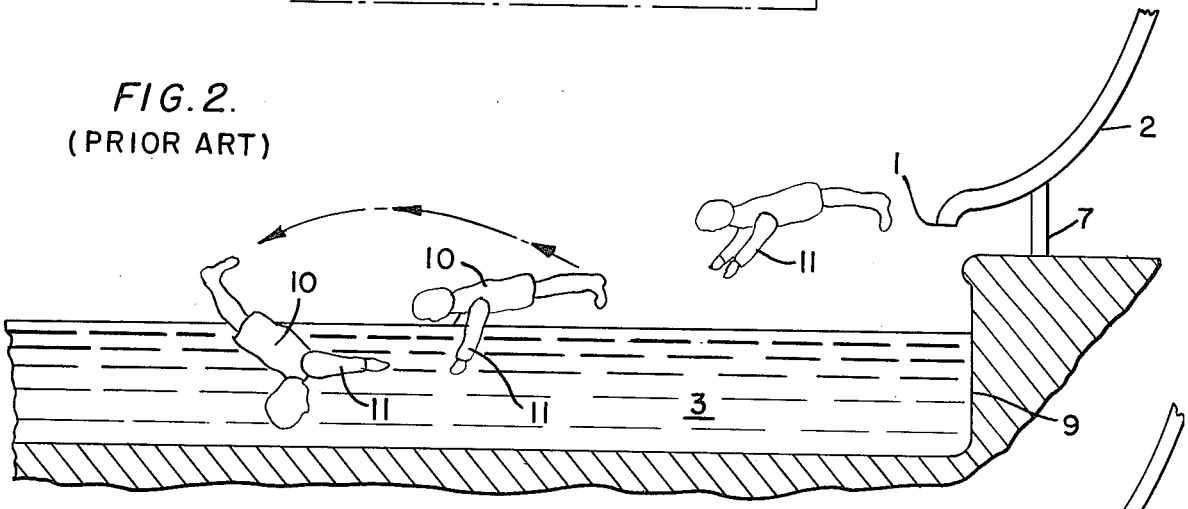
FIG. 2. (PRIOR ART)
FIG. 2 is a side elevational prior-art detail of the shallow end of the pool of FIG. 1 and said slide, plus a child diver entering the water in a realistic but highly dangerous manner, as particularized below.

Referring to the drawings in detail:

In FIGS. 1–6, front 1 of slide 2 (shown as straight although it often would be curved) projects over the water 3 of the pool (unnumbered per se). Mooring hooks 4, 5 respectively grasp front support standards 6, 7 in split-ring fashion, to maintain baffle 8 in juxtaposition to shallow-end wall 9, with its rear end slightly rearward of the vertical plane which includes said front 1. As shown in FIG. 2, a child diver 10, failing to appreciate the danger inherent in permitting his arms to dangle downwardly while in flight, reaches the water with them still dangling, the result being that the water exerts a braking force against them which, due to the ongoing momentum of the rest of his body, causes a sudden and violent somersaulting. This was graphically described and reported on by Dr. Richard G. Snyder, head of the Biomedical Department of the University of Michigan, in a letter dated Mar. 13, 1973, to Mr. Carl Blechschmidt of the Bureau of Product Safety of the Food and Drug Administration of the U.S. Department of Health, Education and Welfare — since succeeded by the United States Consumer Product Safety Commission — copies of which letter are currently available (as of the filling date hereof) to members of the public free of charge at the offices of said Commission, 1750 K Street, N.W., Washington, D.C. As detailed in said letter, such somersaulting has caused numerous cervical injuries of great severity and permanence.

The concave contour of foam baffle surface 8*a* at the left side of FIG. 3 will be discussed below.

It is to be noted that mooring hooks 4, 5 are integral with shanks 12, 13, which are securely sunk in baffle 8, by reason, e.g., of having been supplied as mold inserts for in situ foaming, in the course of fabrication of said baffle 8. Both the interior of the latter and the body structure of hooks 4, 5 plus their shanks 12, 13 advantageously can be of resiliently flexible polyurethane having a bulk density well below that of water, e.g., between about 5 and 35 or 40 pounds per cubic foot. The resulting buoyancy provides appropriate elevation for skid surface 14 to cause the diver's arms 11 to skid frontwardly at a shallow and above-water angle (e.g., even as little as 10° to 15° -- the angle in FIG. 3 was 12°, in the drawings as filed) instead of making a highly dangerous somersault entry into the water in the manner discussed above.

Figure 5:
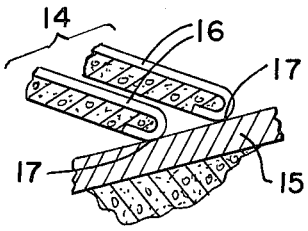
FIG. 5 is a sectional detail on enlarged scale of the novel shingles-type cushioning members indicated in FIG. 3.

As appears in FIG. 5, the presently preferred makeup of the skid surface 14 comprises a relatively stiff lamina 15 suprajacent to the foam interior of the baffle 8, said lamina 15 in turn being subjacent to the above mentioned skid-promoting cushioned-shingle members 16, which latter are disposed in frontwardly leaning mutually parallel manner crosswise of the top of the baffle, and are individually anchored thereto as at loci 17 (FIG. 5). Additionally, said cushioned-shingle members 16 are advantageously covered with individual smooth and slippery outer laminae or surfacings (unnumbered per se) of the same material, e.g., polyurethane, of which said skid-surface lamina 15 is itself comprised, but in water-impervious form.

The foregoing preferred scheme of structural characteristics of the top parts of baffle 8 is based on the following interrelated considerations:

First, the potentially life-saving, or cervical- or spinal-injury preventing function of not only baffle 8 but other baffles of the invention to be particularly described below, is best served by a highly slippery surface and one which is not subject to substantial localized or topical indentations when subjected to downward force such as exerted, e.g., by the aforesaid dangling arms 11 of the FIG. 3 diver. Hence, the desired degree of overall cushioning effect is preferredly spread across the baffle rather than concentrated in a small region thereof.

Second, rebound force of the interior of the baffle should best be minimized, to avoid serious injury due to such rebound force per se. This accounts not only for the streamlining of said "shingles," but for the dominoes-like intercontiguities of the successive "shingles," since the rebound force of any individual one of them becomes of no consequence as soon as the diver's body ceases to be in contact with it. Also, when such contact ceases, the particular part of the diver's body which made such contact is still at a higher elevation than the next "shingle," or at least is in streamlined relation to it; so that no such momentum-arresting effect is engendered as that of the aforesaid "braking," by the water, of the momentum of the downwardly dangling arms 11 of the diver in FIG. 2.

Affixation of the individual shingle members 16 to the lamina 15 can be accomplished by suitable adhesives unless, for example, said lamina consists of a material which does not respond to available adhesives. In the latter case, however, mechanical affixation — e.g., stitching — can be resorted to, or heat-fusion procedures in case the lamina 15 is comprised of a thermoplastic synthetic resin familiar to workers in the involved field of plastics.

Figure 7:
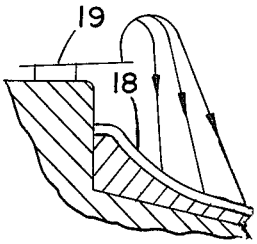
FIG. 7 is an analytical detail of the conventional diving board and novel baffle appearing at the upper left in FIG. 1.

In FIG. 7, baffle 18, disposed in a diving zone (understood), is provided with a frontwardly-upwardly exposed concave skid surface (unnumbered per se) to accommodate diver impacts from a variety of diver descent directions, as indicated by the arrows with their lead lines running from the old-fashioned plank-type diving board 19 to said baffle. It will be noted that as said directions move frontwardly the horizontal component of said upwardly exposed concave surface increases, so that the successive angles between said descents and said skid surface tend to equalize.

Figure 8:
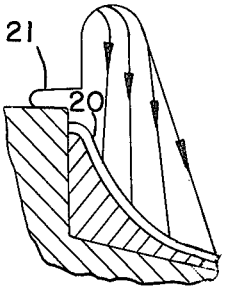
FIG. 8 is the same as FIG. 7 except that the board and baffle are the novel ones appearing at the lower left in FIG. 1.

In FIG. 8 the situation is analogous to that in FIG. 7 except that the concavity of upwardly exposed skid surface 20 faces less upwardly and more frontwardly than does that of baffle 18 of FIG. 7. This difference is predicated on the special power and height-of-dive made available by the novel structure of diving board 21, to be described below.

Figure 6:
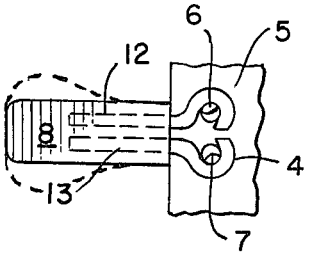
FIG. 6 is a plan detail of the floating baffle of FIG. 3 plus its above-water mooring cables.
Figure 9:
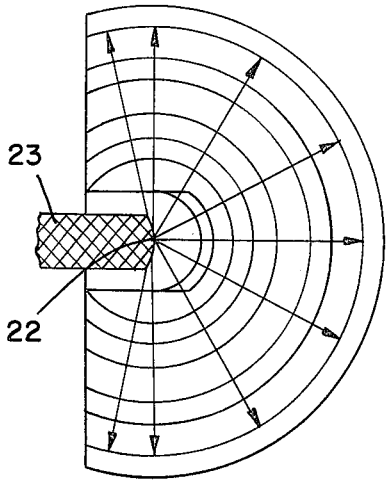
FIG. 9 is a plan detail depicting baffling of the invention the front of whose skid-surfacing has a convex configuration, 2.e., is arcuately correlated to the front of the diving board.

In FIG. 9, the series of arcuate lines (unnumbered) represent the outer tips (also unnumbered) of cushioning members such as 16 in FIGS. 5–6, except that they are all concentric with respect to the midpoint of the upper front 22 of the diving board of platform 23 — the latter may be of any desired construction, and optionally may be completely non-flexing rather than flexing in use.

Figure 10:
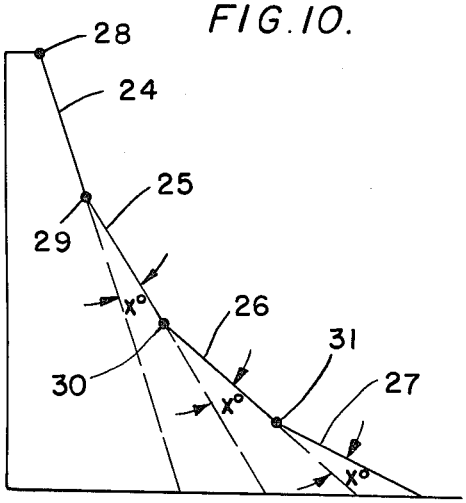
FIG. 10 is an analytical diagram to be referred to below in regard to the contouring of the frontwardly-upwardly concave skid surfaces depicted therein.

In FIG. 10 the concavity of the upwardly exposed skid surface corresponding to that of baffle 18 of FIG. 7 and skid surface 20 of FIG. 8 is analytically represented by successive straight-line segments 24, 25, 26, 27, which, though shown as of equal length, may be of differing lengths, and though forming successive angles of about 15 degrees in the manner shown in FIG. 10, may form angles of mutually differing sizes. Thus, the concave upwardly exposed skid surface of said figure may be designated as comprised of a first segment beginning at point 28 and extending in a direction more nearly vertical than horizontal to a point of turning 29, a subsequent segment 25, also extending in a direction more nearly vertical than horizontal, but with a greater horizontal component than segment 24, to a further point of turning 30, where the process repeats itself in respect to segment 26; an additional point of turning occurring at point 31, after which segment 27, though still sloping downwardly, has a greater horizontal component than any of the preceding segments 24–26. Since the concavities of the above mentioned baffle 18 and skid surface 20 may be thought of as constituted by a large number of successive straightline segments according to the exemplification in FIG. 10, each of the skid surfaces in the baffles of FIGS. 7 and 8 can be analyzed as comprising points of turning such as 28, 29, 30, 31, aforesaid, when it is borne in mind that, as stated, e.g., in the definition of "angle" on page 417 of Funk and Wagnalls New Encyclopedia (1950): "An angle made by two curved lines (*curvilinear*) is the same as that made by the tangents to the two curves at the point of intersection." This observation is included as an aid to understanding claims phraseology appearing hereinbelow.

Figure 11:
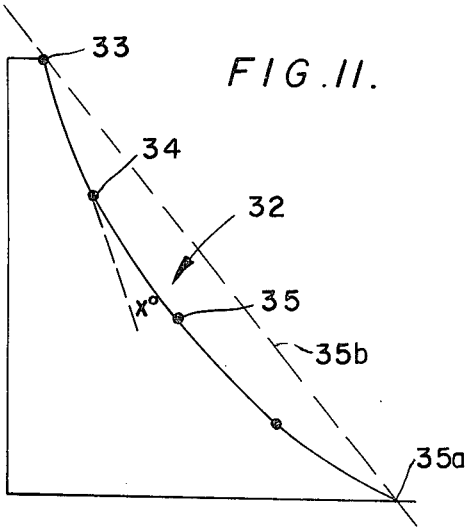
FIG. 11 is similar to FIG. 10 except for differences pointed out below.

In FIG. 11 concave upwardly exposed skid surface 32 represents a continuous curve such as postulated above wherein the direction of concavity is upwardly-frontwardly and the extent of curvature is such that in progressing downwardly from illustrative point 33 a point of turning is soon reached at which the initial direction (determined by an imaginary straight line tangent to the curvature at said point 33) has changed sufficiently to be at an angle of $x$ degrees with said line of tangency at locus 34, and a similar further angular change is again reached at locus 35. While the imaginary lines of tangency thus involved, and imaginary specific values for the angles $x$, are omitted for the sake of simplicity, it may be noted that if said angles happened to be each equal to 15 degrees and said segments happened to be mutually equal in length, the above dicussion of segments 24, 25, 26, 27 plus points of turning 28, 29, 30, 31 of FIG. 10 would be applicable to skid surface 32 of FIG. 11.

Figure 12:
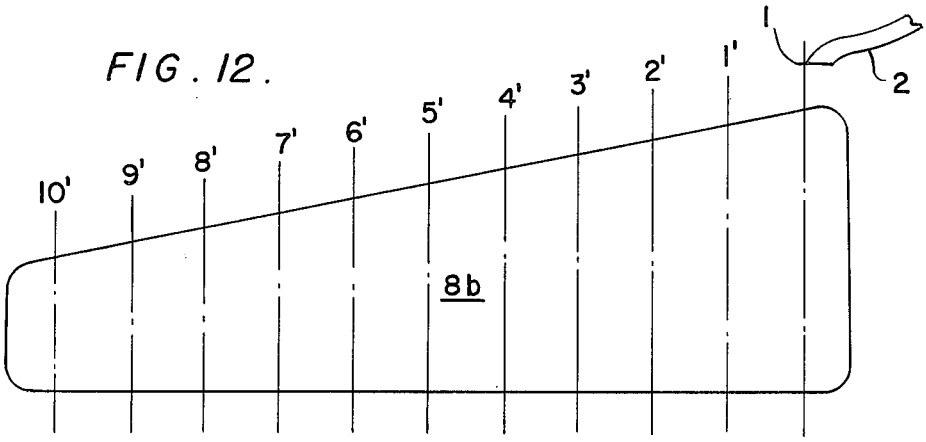
FIG. 12 is a side elevation on enlarged scale of a baffle similar to that of FIG. 3 except for omission of the shingles-type cushioning members.

Particularly in respect to baffle 8 of FIGS. 1, 3, 4, 6, as well as baffle **8*b* of FIG. 12, it may be desirable to have their skid surfaces transversely upwardly concave so as to form a guide trough, so to speak, for the head-first slider. Visualization of a cross-sectional contour for such a trough will be facilitated by considering the curved line extending from numeral 33 to numeral 35*a* on FIG. 11** as illustrative of such a crosssectional contour.

In further regard to FIG. 7–11, it is to be understood that such fill-in structure (whether of foam, framework or both) as may be needed for those portions of the baffles which extend rearwardly from the imaginary vertical plane which includes the front of the particular diving board or platform and is parallel to the wall of the pool, will depend on the architecture of the particular pool.

Figure 3:
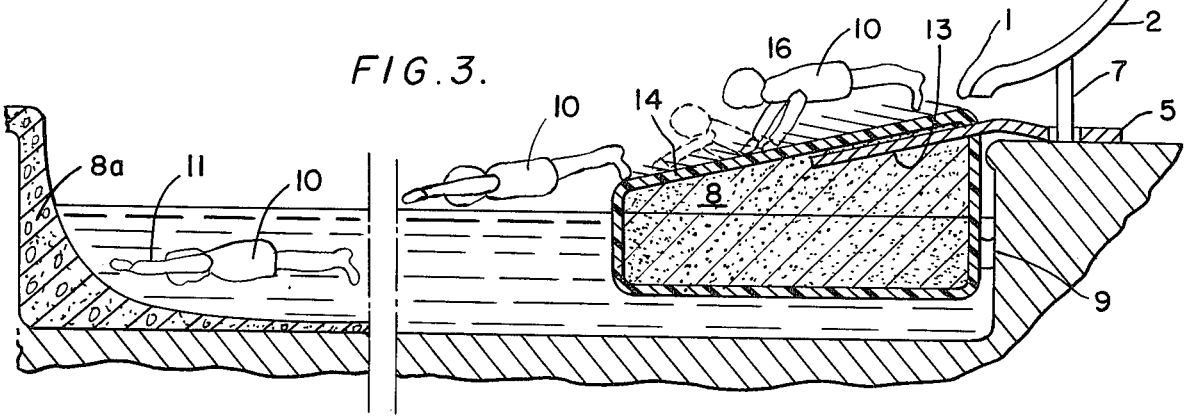
FIG. 3 is essentially the same as FIG. 2 except that a baffle of the invention is causing the downwardly dangling arms of the diver to skid frontwardly, thereby preventing unintended somersaulting such as depicted in FIG. 2.
Figure 4:
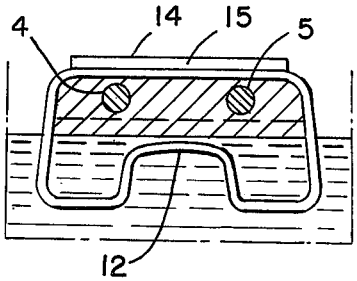
FIG. 4 is a rear elevation, with cable structure cut away, of the floating baffle of FIG. 3.

The similarity in appearance between the contouring of baffles 18 and 20 of FIGS. 7 and 8, on the one hand, and the contouring of baffle **8*a* at the left side of FIG. 3** on the other, does not mean that the latter is intended to be covered by the appended claims, i.e., unless their terms apply to it per se as distinguished from its merely being a component of the pool assembly.

In FIG. 12 baffle 8*b* extends from a first locus rearward of the front of slide 2 to a second locus over 10 feet forwardly thereof. The long-short dash lines on this figure will be analytically referred to hereinbelow.

A disclosure of interest in connection with the subsurface cushioning layer in the baffles of the invention occurs in Clary U.S. Pat. No. 3,271,787. Although dealing with the problem of slipperiness of pool coping when wet, and aiming to make it less slippery rather than more slippery (as would be the aim in respect to the skid surfaces of the subject invention), said patent contains an interesting discussion of the utility of coping body structure (Column 3, lines 20–29) "fabricated of a resilient, preferably spongy, material, such as a spongy synthetic plastic" whereby "the shock or force of the impact upon the person is thereby greatly reduced, and personal injury, such as bruises, cuts or bone fractures, are rendered much less likely and their severity minimized."

Pertinent disclosures of the use of polyethylene, polypropylene, nylon, and analogous materials for the skid surfaces of the subject baffles occur in Chase U.S. Pat. No. 3,665,523 and Diemond et al. U.S. Pat. No. 3,497,877, both of which pertain to pool slides. Also of interest are the disclosures of slippery fiberglass skins for water skis in Saucier U.S. Pat. No. 3,736,609 and Fortin U.S. Pat. No. 3,027,575, as well as analogous use of fiberglass skin along with "a body of foam within the fiberglass skin" for "surface board construction" in Smith U.S. Pat. No. 3,802,010. In addition, Forshee U.S. Pat. No. 3,638,992 is of interest for the showing in its figure 6 of a "foamed sheet, having air pockets" and "bonded to . . . plastic . . . surface", or for "impact shock absorbing . . . in automotive and aircraft vehicles."

In FIGS. 13–21, hairpin-type spring 36 embodies the novel principle analytically exemplified by FIG. 8 of applicant's U.S. Pat. No. 3,083,965, which principle may be expressed as that of a rearwardly reverse-convoluted bending-lever diving board.

Additionally, in connection with FIGS. 13–21, it will be apparent from applicant's above cited U.S. Pat. No. 3,083,965 that the leverage action of hairpin spring 36 is produced by down-movement during use of its upper tine 37, which causes upward fulcrumming of the spring 36 against fulcrum 59 supplied by cylinder 60, constituting the top of an inverted U-shaped anchorage (understood) embedded in the pool deck in conventional manner. The "effort" in said leverage action occurs of course at anchor pivot 61, it being the point in the surface of said deck against which the lower end of spring 36 bears down under the weight of a diver during use.

Advantageously, the underside of said cylinder 60 will be surfaced with teflon, nylon or the like, as also will the top surface 62 of underlying support member 63.

The embodiment of said principle in instant FIGS. 13–21 comprises several basically new improvements, as a result of which said embodiment (based on tests applicant has made with reduced-scale prototypes) appears to possess unprecedented safety in use, unprecedented "sending" power, unprecedented spring force per unit of front-rear poolside space requirements, and unprecedented economy in cost.

Figures 13, 14, 15, 16, 17, 18, 19, 20, 21, 22:
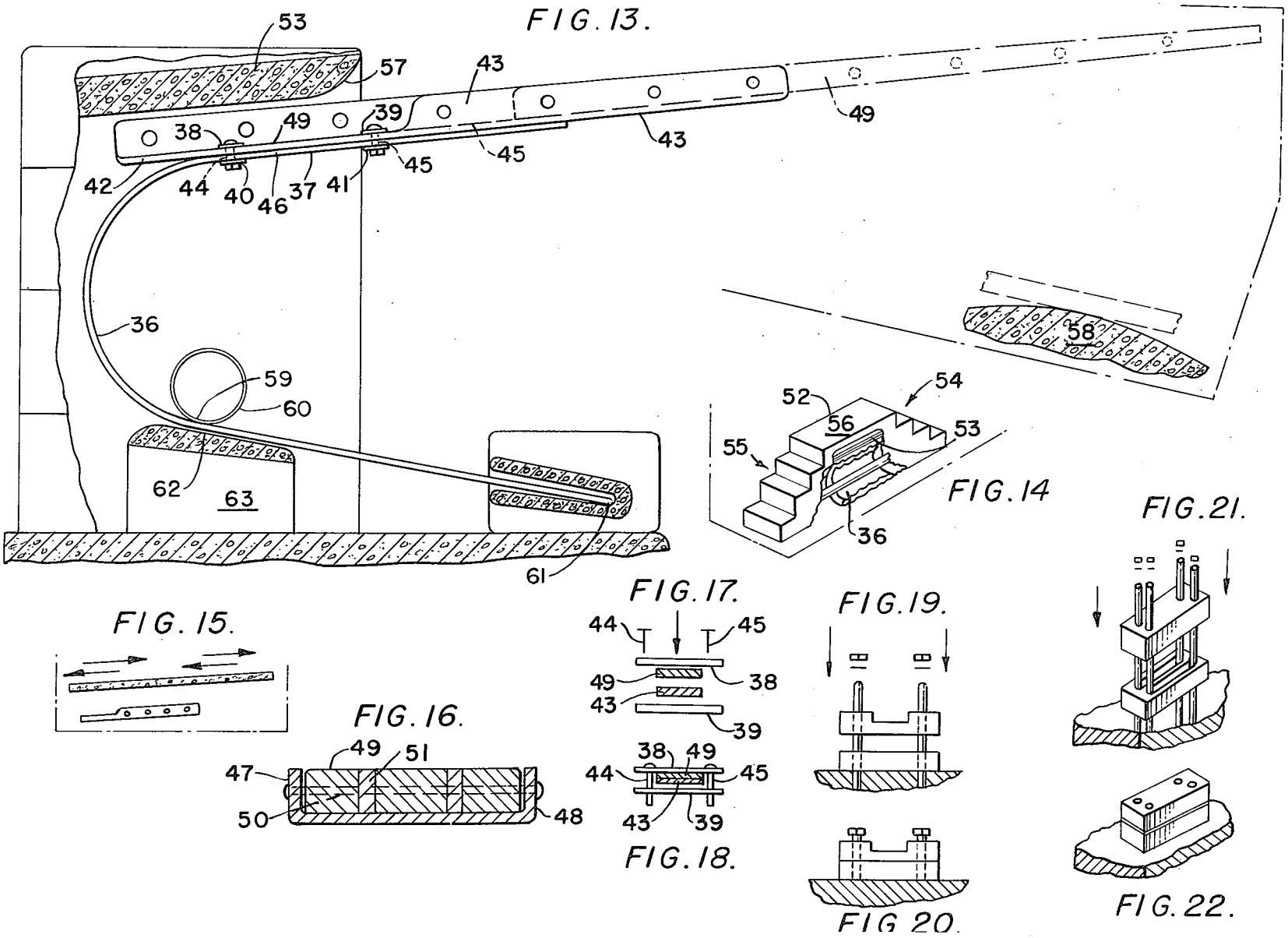
FIG. 13 is a side elevational view, with certain parts broken away, of the diving board assembly indicated at the lower left in FIG. 1 and believed to be basically new, per se, both from the standpoint of safety and a number of further respects pointed out below.
FIG. 14 is a front perspective detail of the multipurpose rear housing structure appearing in FIG. 13.
FIG. 15 is an exploded sectional detail of the dual platform structure supported by the upper tine of the hairpin-type spring appearing in FIG. 13.
FIG. 16 is a cross-sectional detail of the upper and lower platform members supported by and affixed to the hairpin-type spring of FIG. 13.
FIG. 17 is an exploded detail in right-side elevation of the two pairs of upper and lower clamp bars interuniting the rear portions of the platform members of FIG. 13 and securing them to the upper surface of the upper tine of the aforesaid spring.
FIG. 18 is the same as FIG. 17 except that the parts have been united through the medium of the bolts appearing at the top of FIG. 17.
FIG. 19 is an exploded front elevational detail of the fulcrum support bar which directly underlies the cylindrical fulcrum member appearing in FIG. 13, plus a shim bar resting on the pool deck below.
FIG. 20 is the same as FIG. 19 except that said support bar and said shim have been united by tightening down of the nuts and washers appearing at the top of FIG. 19, onto the top of said support bar via downthreading onto the elongate vertical stud bolts rising from a jig (understood) buried in the concrete underlying the surface of the pool deck.
FIG. 21 is analogous to FIG. 19 except that there are four such stud bolts and the exploded parts are, respectively, an anchor pivot-providing bar such as appears adjacent the front of the pool deck in FIG. 13 and a shim bar which for purposes of illustration has greater vertical thickness than that of FIG. 19.
FIG. 22 is analogous to FIG. 20 except in relation to FIG. 21 rather than FIG. 19.

In said FIGS. 13–21 the upper tine 37 of said hairpin spring 36 supports and is inseparably integrated to (by overlying outwardly extending clamp bars 38, 39 and underlying outwardly extending clamp bars 40, 41) rearward portion 42 of lower platform member 43, said outwardly extending clamp bars being tightly interunited by pairs of bolts 44, 45 (optionally supplemented by waterproof epoxy gluing-together of the upper front surface (unnumbered) of said tine 37 to the contiguous under-surface (also unnumbered) of said lower platform member 43, as at locus 46 in FIG. 13).

Said lower platform member 43 has upturned flanges 47 and 48, as best seen in FIG. 16, by virtue of which it has the rigidity and strength of a channel iron. The thickness of upper platform member 49 is tapered so that the pitch of its top or tread surface is less than the relatively exaggerated pitch of lower platform member 43. Also, it is provided with lengthwise adjustability relative to lower platform 43 (as best seen in FIG. 15) through the medium of horizontally transverse, mutually complementary sequences of pinholes (unnumbered) respectively located in said lower platform 43 and said upper platform 49. Thus, by sliding the latter along the former until a selected alignment relationship is achieved, and then inserting fastening pins transversely through the aligned holes as indicated in FIG. 16, secure integration of upper platform 49 to lower platform 43 is achieved.

Referring again to FIG. 16, longitudinally extending joists 51 serve as rigid anti-flex members, they in turn being reinforced by rigid, relatively lightweight plastic foam, e.g., of polyurethane.

To aid in conserving front-rear overall dimension, housing 52 — besides supplying an overlying shock-absorbing cushion 53 for dampening backlash of the spring 36 in use — provides a pair of laterally positioned step-wise approaches 54 and 55, best seen in FIG. 14, the same being joined by roof 56.

Said cushion 53 is flared as at 57 to preclude injurious entry of bystanders' hands.

Highly significant economy in cost of manufacture of each of the aforesaid platform members is made possible by the fact that each one of them is fully non-flexing in use; said fact also making possible the extremely simple scheme of adjustability depicted in FIGS. 15 and 13.

The functioning of the parts in FIGS. 19–22 is believed clear from the non-numeralized description of the same already set out hereinabove. Also, it may be mentioned that applicant makes no claim to inventorship of the broad concept of controlling pitch by use of shims.

Reverting to FIG. 13 in particular, it sould be remarked that front down-stop cushion 58 is so located that it will never be engaged by the front of the upper platform member 43 of the diving board unless the board is subjected to overload. This of course is to insure against fracture. It is understood that the only other cause of fracture in steel is fatigue, and ample forewarning of it is readily achievable, as will be discussed below.

For the spring steel to be used for fabricating spring 36 of FIG. 13, the type known commercially as "Type 6152 steel" may be used, "it being," as stated in U.S. Pat. No. 3,408,061, Column 3, "known to respond well to heat-treating techniques for obtaining desired spring characteristics".

The cross-sectional dimensions for said spring 36 may be, e.g., 1 inch or 1¼ inches × 8 inches. Also, it is believed that the spring can well be fabricated of fiberglass, if desired, rather than steel.

Of course, the bearing surfaces in FIG. 13 will advantageously be provided with a teflon or nylon exterior.

For the tread surfaces at the front of the diving board of FIG. 13, the "Safety Mat with Target" of Gabrielsen et al. U.S. Pat. No. 3,178,333 may be used.

Down-stops analogous to cushion 58 at the far right side of FIG. 13 are to be found in applicant's U.S. Pat. No. 3,083,965 (FIGS. 30–31 and 38), as well as his U.S. Pat. No. 3,166,315 (FIGS. 39–42).

Since only the spring 36 flexes during use of the diving board of FIGS. 13–18, the structure and fabrication of its platform members 43, 49 can be accomplished at relatively exceptionally low cost. And for use as the rigid foam filler indicated in FIG. 16, the "Polyisocyanurate Foam Structure" in Bonk et al. U.S. Pat. No. 3,644,168 can advantageously be considered. Similarly, as regards the joists 51 in the same figure, the "longitudinal ribs 24" of the diving board of Schumacher U.S. Pat. No. 2,461,086 may be considered.

Optimum safety in respect to the spring 36 is assured when it is fabricated from spring steel, since the latter is unique among materials eligible for use in springs, in that prolonged use does not produce permanent deformation in its shape. In other words — assuming overloading is avoided, as can readily be done by placing a reserve down-stop member such as cushion 58 in position to block excessive down-movement of the upper tine 37 and thereby preclude the possibility of overloading of the board — there will be no fractures from fatigue until cyclical flexures in use have reached such an extremely high number as is requisite to cause a fatigue fracture, and the approach of such a fracture is understood at the present time to have become visually detectible by non-experts generally, e.g., by merely brushing a penetrant-containing liquid mixture on the exposed surface of the flexing part of the steel, said mixture containing a fluorescent dye which penetrates the tiny microcrystalline cracks or surface crevices and thereby makes visible the signs of approaching imminence of fatigue fracture. As to this, the disclosure in Molina U.S. Pat. No. 3,803,051 will be found of particular interest, although there are other lines of attack on the problem which have also undergone substantial development during recent years.

In harmony with the overall safety objectives of the instant application, it may be mentioned that small rowboats or canoes, such as are frequently seen on large-size pools, may well be equipped with the frontward rowing, boat-spanning, angular oars having self-surfacing blades which form the subject of applicant's U.S. Pat. No. 3,857,356. Since the oarsman using such oars is facing in the direction he is rowing, conflict between his craft and divers or sliders, as well as other users of the pool, will be far more easily guarded against than when conventional backward-rowing oars are used.

In the appended claims the term "projector" is to be understood as applying to slides as well as diving boards.

What is claimed is:

1. Safety baffling adapted for placement adjacent a wall of swimming pool, said baffling comprising an upwardly exposed exterior lamina having a skid surface for obliquely intercepting the body of a descending diver happening to make contact with it, and also comprising a cushioning lamina having a lower bulk density than said exterior lamina, formed of resillient plastic foam, and underlying said exterior lamina, said baffling having an overall width of at least 2 feet, an overall length of at least 5 feet, and an overall vertical thickness of at least 1½ feet, and in combination with said baffling means for so securing said baffling in said placement that said skid surface slopes frontwardly-downwardly at an angle of at least 10° with the horizontal.

2. The combination of claim 1 wherein said baffling has an overall bulk density less than that of water, said baffling consequently being inherently floatable in use, said baffling also being provided with cable means for mooring it to the wall structure of a swimming pool.

3. The combination of claim 1 wherein said skid surface is curvilinear as viewed in side elevation and slopes frontwardly-downwardly continuously at least to a point 6 feet frontward of its rear, the sloping having a downward component which gradually lessens throughout said distance.

4. The combination of claim 1 wherein said overall width is at least 4 feet and said overall length is at least 7 feet.

5. In the combination safety baffle of claim 2 a poolside slide mounted on the deck of a swimming pool adjacent water therein with the front of said slide overlying water in said pool, said slide being supported by support structure rising from the deck of said pool and baffling comprising cable structure anchored to said support structure.

6. The combination of claim 5 wherein said baffling has an overall length of at least 9 feet.

7. In combination:

a swimming pool having a deck, a diving zone adjacent said deck, a diver-body projector mounted on said deck, said projector having an exit portion terminating in a front lip, said front lip overlying said zone and being parallel to an edge of said deck which borders on said zone, safety baffling disposed in said diving zone at an elevation lower than, and in a location extendng at least 5 feet farther frontward than, said front lip, said baffling having an exterior lamina comprising an upwardly exposed surface which, in its at-rest posture, slopes downwardly-froontwardly at an angle of at least 10° with the horizontal.

said upwardly exposed surface being disposed for being glancingly contacted by the decending body of a diver projected from said exit portion, said exterior lamina being yieldably supported by cushioning material subjacent thereto and comrised in said baffling, whereby, at the instant said upwardly exposed surface is glancingly contacted as aforesaid, the force of the impact is cushioned and the horizontal component of the trajectory of said body is concomitantly increased.

8. The combination of claim 7 wherein:

said baffling is supported by a bottom wall portion of said pool, and said upwardly exposed surface is submerged in water in said pool during use.

9. The combination of claim 8 wherein:

the front of said baffling has a convex configuration in relation to the front of said projector.

10. The combination of claim 1 wherein:

a cross-section of said upwardly exposed exterior lamina has an upwardly concave, trough-like contour.

* * * * *

UNITED STATES PATENT OFFICE
CERTIFICATE OF CORRECTION

PATENT NO. : 3,942,198

DATED : March 9, 1976

INVENTOR(S) : Harold A. Jewett

It is certified that error appears in the above-identified patent and that said Letters Patent are hereby corrected as shown below:

1. Column 3, line 23, "2" should be: --i--.
2. Column 9, line 66, after "of" insert: --a--.
3. Column 10, line 35, after "and" insert: --said means for securing said --.

Signed and Sealed this

*eleventh* Day of *May 1976*

[SEAL]

*Attest:*

RUTH C. MASON
*Attesting Officer*

C. MARSHALL DANN
*Commissioner of Patents and Trademarks*